US006712220B2

(12) United States Patent
Ruigrok et al.

(10) Patent No.: US 6,712,220 B2
(45) Date of Patent: Mar. 30, 2004

(54) SORTING AND PACKAGING PRODUCTS

(75) Inventors: Albertus Johannes Ruigrok, Pijnacker (NL); Johannes Cornelis J. Tas, Nootdrop (NL)

(73) Assignee: FPS Food Processing Systems B.V., RE Nootdorp (NL)

( * ) Notice: Subject to any disclaimer, the term of this patent is extended or adjusted under 35 U.S.C. 154(b) by 19 days.

(21) Appl. No.: 09/809,426

(22) Filed: Mar. 16, 2001

(65) Prior Publication Data

US 2002/0008054 A1 Jan. 24, 2002

(30) Foreign Application Priority Data

Mar. 16, 2000 (EP) ..... 00200932

(51) Int. Cl.[7] ..... B65B 57/00; B07C 5/16
(52) U.S. Cl. ..... 209/592; 209/645; 53/54
(58) Field of Search ..... 209/592, 593, 209/645, 646, 912, 919; 53/54, 143, 202, 544

(56) References Cited

U.S. PATENT DOCUMENTS 3,815,313 A * 6/1974 Heisler ..... 53/413
4,530,435 A * 7/1985 Stohlquist ..... 53/54 X
4,708,250 A * 11/1987 van der Schoot ..... 209/592
5,246,118 A * 9/1993 Mosher ..... 209/592
5,406,770 A * 4/1995 Fikacek ..... 53/54
5,998,754 A 12/1999 Pervieux
6,349,526 B1 * 2/2002 Newman ..... 53/446

FOREIGN PATENT DOCUMENTS

DE 2555192 * 6/1977 ..... 209/592

* cited by examiner

*Primary Examiner*—Donald P. Walsh
*Assistant Examiner*—Joseph Rodriguez
(74) *Attorney, Agent, or Firm*—Stites & Harbison PLLC; Marvin Petry

(57) ABSTRACT

The invention relates to a method and apparatus for packaging products, such as vegetables and fruits, utilizing a sorting machine which method includes the steps of determining per product the characteristics of the respective products, such as, for instance, determining their weight and/or their shape; comparing the characteristics with predetermined packaging requirements; on the basis of this comparison, selecting products that do not need to be packaged; supplying the other, non-selected products to a packaging unit, which packaging unit is energized only when there is a substantially uninterrupted in-feed of the products into the packaging unit.

11 Claims, 1 Drawing Sheet

SORTING AND PACKAGING PRODUCTS

FIELD OF THE INVENTION

The present invention relates to a method and apparatus for sorting and packaging vegetables and fruit, such as, for instance, cucumbers, gherkins, and cauliflowers.

In particular, this invention relates to a method for characterizing, selecting, classifying, sorting, and packaging products, such as vegetables and fruits, comprising the successive steps of:

characterizing the products, such as determining their weight or their shape, whereby characteristics of each product are obtained which are automatically stored, and selecting, classifying and sorting the products according to these characteristics, while products for pre-set classes are supplied as streams of products with a sorting apparatus to discharge conveyor tracks and/or packaging tracks intended for these classes.

BACKGROUND OF THE INVENTION

Such a method and apparatus for carrying out this method are known, for instance from European patent EP 810963. It discloses how elongate products such as carrots are supplied to a sorting machine, are classified with the detection equipment present on this machine, and are subsequently supplied to discharge conveyor tracks. In most cases, this is followed by the path of packaging these products. As can be derived from that patent specification, this could be carried out after each discharge conveyor track.

Especially for the elongate products mentioned in this patent, such as carrots, but cucumbers in particular are to be considered here as well, packaging requires a special treatment. This is the case in particular when each product is to be packaged individually. To that end, often use is made of sealing machines, which wrap the respective products individually with plastic and subsequently close this wrapper with a heat seal. These machines are generally known to work best with a continuous product supply and also at a constant speed.

In the sorting machine as described above, this inevitably leads to logistic problems. Not only will the supply be irregular because of the ejection of products having deviant characteristics, but moreover, as a result of the characterization, called calibration in EP 810963, the supply streams over the different discharge conveyor tracks will regularly be discontinuous. With corresponding regularity, the sealing machines will be deprived of supply, and must then be switched off. The least negligence in this regard may lead to a defective sealing machine. Moreover, connecting several packaging tracks each to a sealing machine is very costly.

SUMMARY OF THE INVENTION

In order to obviate the above-mentioned disadvantages, the invention provides a method for packaging products, such as vegetables and fruits, utilizing a sorting machine, the method comprising the following steps:

determining per product the characteristics of the respective product, such as, for instance, determining their weight and/or their shape;

comparing the characteristics with predetermined packaging requirements;

on the basis of this comparison, selecting products that do not need to be packaged;

supplying the other, non-selected products to a packaging unit, the packaging unit being energized only when there is a substantially uninterrupted in-feed of the products into the packaging unit.

More particularly, the method according to the invention comprises:

comparing the characteristics with packaging requirements, selecting those products that do not satisfy the packaging requirements, discharging the selected products from the sorting apparatus to the discharge conveyor tracks, supplying the other products from the sorting apparatus to at least one packaging unit for the packaging thereof, the packaging unit being energized only when there is uninterrupted in-feed of the products into the packaging unit The major advantage of the method according to the invention is that only a single stream of products needs to be taken into account, so that logistics, both in terms of the construction of the apparatus and in terms of the control thereof, can be simplified considerably.

In a further embodiment of the invention, the uninterrupted in-feed of the products into the packaging unit takes place after collection and feed-through of these products with a buffer track.

With this relatively simple intervention, in an adequate manner a highly advantageous supply stream is obtained, which can ensure a continuous stream of products in a suitable manner.

With great advantage, the present invention also provides an apparatus for sorting and packaging products, such as vegetables and fruits, comprising:

a sorting apparatus comprising a main conveyor track for conveying supplied products to a number of discharge conveyor tracks and/or packaging tracks, detection means for determining characteristics of products to be processed, such as, for instance, shape, weight and/or color;

a packaging unit for packaging a substantially uninterrupted product stream; and a control which is connected to the detection means and which is arranged for comparing the characteristics observed by the detection means with predetermined packaging requirements, on the basis of this comparison selecting products that do not need to be packaged, and supplying the other, non-selected products to a packaging unit, the packaging unit being energized only when there is a substantially uninterrupted in-feed of these products into the packaging unit.

More particularly, the apparatus comprises:

a sorting apparatus, having a feed roller track for continuously supplying products, a main conveyor track for conveying the supplied products to discharge conveyor tracks and/or packaging tracks, detection means for determining characteristics of the products, such as determining their weight or their shape, and a computer, having a control unit, for controlling the detection means, and for processing and storing the characteristics of each product, and having a processing unit, for classifying the products on the basis of the characteristics, for selecting the classified products, and for allocating the classified products to the discharge conveyor tracks and/or packaging tracks, while the processing unit, prior to allocation, compares the selected products with packaging requirements, while the products that do not satisfy the packaging requirements are allocated to and are discharged to the discharge conveyor tracks, and the other products are discharged to at least one packaging unit which is energized by the control unit only when there is uninterrupted in-feed of these products into the packaging unit.

In particular, the uninterrupted in-feed of the other products referred to is carried out with a buffer track In a highly advantageous manner, the buffer track, linking up with the main conveyor track, comprises, in succession, a first flat conveyor track, a roller track, and a second flat conveyor track, while the uninterrupted in-feed is effected from the control unit by controlling and configuring the individual speeds of the tracks.

What can be regarded as a major advantage is that in many cases a single sealing machine can suffice, so that connecting several discharge conveyor tracks to as many sealing machines is no longer necessary.

BRIEF DESCRIPTION OF THE DRAWINGS

Hereinafter, the invention will be elucidated with reference to the accompanying drawing, wherein FIG. 1 schematically shows an apparatus according to the prior art, FIG. 2 schematically shows an apparatus according to the invention.

DETAILED DESCRIPTION OF THE PREFERRED EMBODIMENTS

Corresponding parts and components of the apparatuses will be numbered correspondingly.

Figure 1:
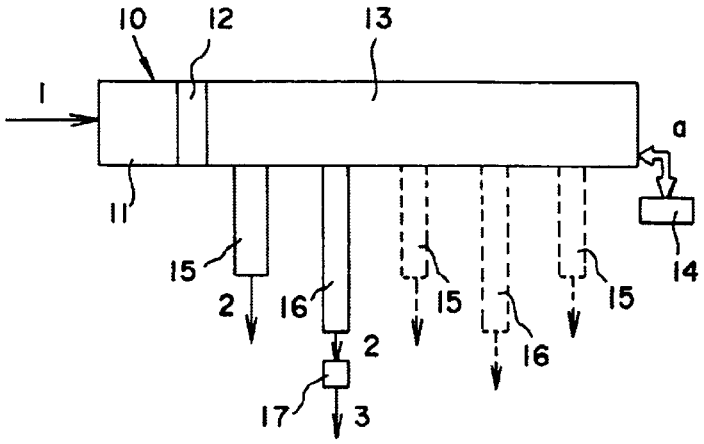
FIG. 1 PRIOR ART

In FIG. 1, according to the prior art, a supply stream 1 of products is supplied to a sorting apparatus 10. The products first enter a generally known feed roller track 11, for instance a single feed row with elongate rollers extending in transverse direction, or, for instance, hourglass-shaped rollers for more spherical products. In a known manner, these rollers are connected to endless chains on either side.

Next, the products, optionally on separate rollers, are passed along detection means 12, which, in a known manner, determine various characteristics of each product, such as weight, shape, color, and contaminations present on the surface. The data thus obtained are supplied as labels to a computer 14 along a signal path a.

Thereupon, the products are passed on to a main conveyor track 13, for instance a single row of transversely directed elongate cups for elongate products, or several rows of squarer cups for more spherical products.

Connected to this track 13 are several discharge conveyor tracks 15 and/or packaging tracks 16, which, in most cases, pass under track 13, so that the products can be discharged from track 13 onto tracks 15, 16, typically endless conveyor belts, sometimes in the form of brush conveyors.

The discharge of the products takes place through control from a control unit of the computer along signal path a, in accordance with product classes previously set for the tracks 15, 16 and assigned to the products in accordance with the data obtained The products in tracks 15, 16 are discharged as output streams 2 for direct transport, or to a packaging unit 17, for instance to be sealed, whereafter the packaged products are discharged as output stream 3 for further transport.

Figure 2:
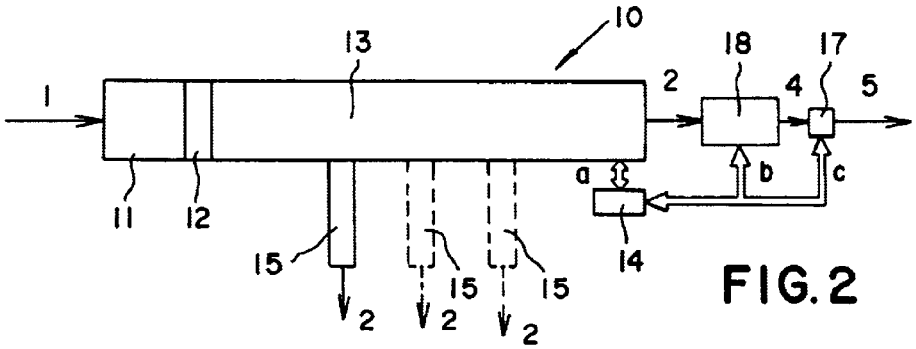

FIG. 2 shows a diagram of a sorting apparatus according to the present invention. In the diagram, which for a number of components corresponds to that of FIG. 1, it can be seen that it is exclusively sorting that takes place along discharge conveyor tracks 15. It is to be noted that in practice, these tracks 15 are sometimes referred to as "discharge conveyor tracks" and/or "packaging tracks". This is to indicate that the packaging of the products does not proceed by this route. Instead, the output stream 2 of the products to be packaged is passed further to a buffer track 18. From the buffer track 18 the products proceed as a packaging supply stream 4 to the packaging unit 17 downstream thereof, whereafter they are carried off as packaged stream 5 for any further handling.

To arrange for the buffer track 18 to deliver an uninterrupted packaging supply stream as much as possible, the control unit of the computer 14 provides for the control and configuration of the individual speeds of the main conveyor track 13, of this buffer track 18, and of the packaging unit 17, indicated in the figure with the signal paths a, b, and c.

Figure 3:
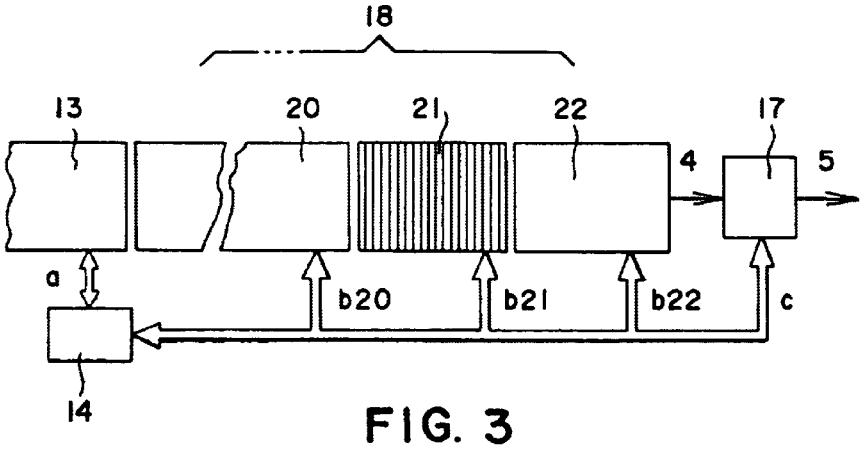
FIG. 3 shows in detail an exemplary embodiment of the apparatus according to the invention.

FIG. 3 shows in detail an exemplary embodiment of the apparatus according to the invention, in which buffer track 18 further comprises, in succession, a first flat endless track 20, a horizontal endless roller track 21, and a second endless flat track 22. In detail, corresponding signal paths b20, b21, and b22 are indicated.

In this exemplary embodiment, buffering, i.e., accumulating a store on buffer track 18 to thereby ensure an uninterrupted stream 4, can be effected as follows. Since the packaging unit 17 generally runs at a constant speed, all preceding operations will have to be adjusted accordingly as much as possible. Thus, it can be seen in the figure that in the preceding sorting step, products will be discharged along discharge conveyor tracks 15. This has as a result that the stream of products from the main conveyor track 13 to the buffer track 18 will be interrupted regularly. In general, therefore, the speed of the main conveyor track 13 will be greater than that of the packaging unit 17. The buffer track 18 constitutes the bridge between track 13 and the packaging unit 17.

To provide unit 17 with an uninterrupted supply, track 22 must run at a speed in line with the in-feed portion of unit 17, for instance an accordion conveyor with which products such as cucumbers are passed inside one by one. Roller conveyor 21, as schematically indicated in FIG. 3, comprises freely rotating and transversely extending rollers, the whole being designed as an endless track. With it, the supply, and in particular the interruptions in the supply, can be taken up. Also track 21 will continue to rotate as much as possible. If an interruption occurs in track 13, track 21 will continue to rotate until on track 22 the supply is interrupted to an undue extent. If the supply from track 13 is too large, track 21 is going to run slower for a while. The freely rotating rollers will generally be able to take up any damming up. When the stream is continuous again, the preceding speeds will be adjusted accordingly.

It will be clear to anyone skilled in the art that the control unit must be supplied with or driven by signaling with product stream monitors, such as photocells, cameras, or the like. Depending on the selected control logic, a suitable number of monitors are arranged above or next to the buffer track 18.

According to a further advantageous exemplary embodiment, for the packaging unit 17 to run continuously, always a minimum of products, also referred to as buffer limit, is furnished on track 22. This limit will to a large extent determine the switch-on and switch-off and speed settings.

From the above-described elucidation of the invention, however, it will be clear to anyone skilled in the art that the idea of a buffer to compensate for 'gaps' in the supply is essential to ensure the operation of the sensitive packaging section of the apparatus. Thus, many variants on the exemplary embodiment will be possible, likewise allowing speeds to be controlled and configured. In addition, such an apparatus can be modified for other products than cucumbers, such that these products will also be packaged in a continuous manner. Also, the flat tracks indicated could be replaced with any suitable conveyor belt, or even a brush conveyor.

It will further be clear that the products that have been passed to the packaging unit and have been packaged therein can optionally be fed into the sorting apparatus again to be subsequently sorted according to class. Naturally, such products which have meanwhile been packaged will then be selected as products that do not need to be packaged.

What is claimed is:

1. A method for packaging irregular shaped products utilizing a sorting machine, comprising the steps of:

determining per product the characteristics of the respective products;

comparing the characteristics with predetermined packaging requirements;

on the basis of this comparison, selecting products that do not need to be packaged;

supplying the other, non-selected products to a packaging unit, the packaging unit being a sealing machine requiring, in operation, a substantially continuous supply of product, which sealing machine wraps the respective products individually and subsequently closes this wrapper with a heat seal; and a control unit which is connected to product stream monitors for obtaining information about the continuity of the product stream supplied to the sealing machine; and energizing the sealing machine only when there is uninterrupted in-feed of said products into the sealing machine.

2. A method according to claim 1, including discharging the selected products that do not need to be packaged to discharge conveyor tracks of the sorting machine; wherein, depending on the determined characteristics of a respective product, this product is passed to a discharge conveyor track associated with those characteristics, so that each of the discharge conveyor tracks receives particular classes of products.

3. A method according to claim 1, wherein the uninterrupted in-feed of the products into the packaging unit takes place after collection and feed-through of these products on the buffer track.

4. A method according to claim 3, including setting a buffer limit for the collection and feed-through of the products.

5. A method for characterizing, selecting, classifying, sorting, and packaging irregular shaped products comprising the successive steps of:

characterizing the products, whereby characteristics of each product are obtained which are automatically stored, and selecting, classifying and sorting the products in accordance with these characteristics, while products for pre-set classes are supplied with a sorting apparatus as streams of products to either discharge conveyor tracks or packaging tracks;

the method further comprising the steps of:

comparing the characteristics with packaging requirements, selecting those products which do not satisfy the packaging requirements, discharging said selected products from the sorting apparatus to the discharge conveyor tracks, supplying the other products from the sorting apparatus to the packaging track which comprises at least one packaging unit for the packaging thereof, the packaging unit being a sealing machine requiring, in operation, a substantially continuous supply of product, which sealing machine wraps the respective products individually and subsequently closes this wrapper with a heat seal; and a control unit which is connected to product steam monitors for obtaining information about the continuity of the product stream supplied to the sealing machine; and energizing the sealing machine only if there is uninterrupted in-feed of said products into the sealing machine.

6. An apparatus for sorting and packaging irregular shaped products, comprising:

a sorting apparatus comprising a main conveyor track for conveyance of supplied products to discharge conveyor tracks or packaging tracks, detection means for determining characteristics of products to be processed;

a packaging unit for packaging a substantially uninterrupted product stream;

the packaging unit being a sealing machine requiring, in operation, a substantially continuous supply of product, which sealing machine wraps the respective products individually and subsequently closes this wrapper with a heat seal;

a control unit connected to the detection means and arranged for comparing the characteristics observed by the detection means with predetermined packaging requirements, and on the basis of this comparison selecting products that do not need to be packaged, and supplying the other, non-selected products to the sealing machine;

the control unit being connected to product stream monitors for obtaining information about the continuity of the product stream supplied to the sealing machine; and the control unit being capable of energizing the sealing machine only when there is a substantially uninterrupted in-feed of said products into the sealing machine.

7. An apparatus according to claim 6, wherein the control unit is arranged for discharging the selected products that do not need to be packaged, to the discharge conveyor tracks, while, depending on the determined characteristics of a respective product, a discharge conveyor track associated with those characteristics is selected for the discharge, so that at each of the discharge conveyor tracks particular classes of products are delivered.

8. An apparatus according to claim 6, wherein the apparatus comprises a buffer conveyor which is arranged upstream of the packaging unit for the purpose of the uninterrupted in-feed of said other products into the packaging unit.

9. An apparatus according to claim 8, wherein the buffer conveyor, linking up with the main conveyor track, comprises, in succession, a first flat conveyor, a roller conveyor, and a second flat conveyor, while the uninterrupted in-feed is effected from the control by controlling and configuring the individual speeds of the conveyors.

10. An apparatus according to claim 6, wherein the total unit is connected to product stream monitors in order that information is available about the continuity of the product stream supplied to the packaging unit.

11. An apparatus for characterizing, selecting, classifying, sorting and packaging irregular shaped products comprising:

a sorting apparatus, having:

a feed roller track for continuously supplying products, a main conveyor track for conveyance of the supplied products to discharge conveyor tracks or packaging tracks, detection means for determining characteristics of the products and a computer having a control unit for controlling the detection means, and for processing and storing the characteristics of each product, and having a processing unit for classifying the products on the basis of the characteristics, for selecting the classified products, and for allocating the classified products to the discharge conveyor tracks or packaging tracks, wherein the processing unit, prior to allocation, compares the selected products with packaging requirements, wherein the products that do not satisfy the packaging requirements are allocated to and are discharged to the discharge conveyor tracks, and wherein the other products are discharged to at least one packaging unit;

the packaging unit being a sealing machine requiring, in operation, a substantially continuous supply of product, which sealing machine wraps the respective products individually and substantially closes this wrapper with a heat seal;

the control unit being connected to product stream monitors for obtaining information about the continuity of the product stream supplied to the sealing machine; and the control unit being capable of energizing the sealing machine only when there is uninterrupted in-feed of said products into the sealing machine.

* * * * *